US006889861B2

(12) United States Patent
Arcati et al.

(10) Patent No.: US 6,889,861 B2
(45) Date of Patent: May 10, 2005

(54) BEVERAGE CAN

(76) Inventors: Richard Arcati, 27 Seacrest Dr., Llyod Neck, NY (US) 11743; John Jakubowski, 47 Gristmill Dr., Kings Park, NY (US) 11754

( * ) Notice: Subject to any disclaimer, the term of this patent is extended or adjusted under 35 U.S.C. 154(b) by 0 days.

(21) Appl. No.: 10/234,731

(22) Filed: Sep. 4, 2002

(65) Prior Publication Data

US 2004/0040963 A1 Mar. 4, 2004

(51) Int. Cl.[7] ..... B65D 17/34
(52) U.S. Cl. ..... 220/269; 220/270; 220/906
(58) Field of Search ..... 220/269, 270, 220/271, 618, 619, 620, 906

(56) References Cited

U.S. PATENT DOCUMENTS 4,480,763 A * 11/1984 Schneider ..... 220/269
4,572,398 A * 2/1986 Juty ..... 220/271
4,872,597 A 10/1989 Hanafusa
4,913,305 A 4/1990 Hanafusa et al.
5,762,230 A * 6/1998 Policappelli ..... 220/62.12
5,813,561 A * 9/1998 Chang et al. ..... 220/269
5,819,973 A * 10/1998 Traub et al. ..... 220/271
6,450,359 B1 * 9/2002 Chang et al. ..... 220/269

FOREIGN PATENT DOCUMENTS

JP 04189747 A * 7/1992 ..... B65D/17/34
JP 08133277 A * 5/1996 ..... B65D/8/02
JP 09150819 A * 6/1997 ..... B65D/1/20
JP 10273127 A * 10/1998 ..... B65D/1/20
JP 2003112735 A * 4/2003 ..... B65D/17/34

* cited by examiner

*Primary Examiner*—Derris M. Banks
*Assistant Examiner*—Ali Abdelwahed
(74) *Attorney, Agent, or Firm*—Dilworth & Barrese, LLP.

(57) ABSTRACT

A beverage can has a top provided with a slanted top portion and delimited by a rim which is formed with a dip forming a drinking-facilitating groove.

20 Claims, 3 Drawing Sheets

BEVERAGE CAN

BACKGROUND

1. Field of the Invention

The invention relates to beverage containers or cans having a rupturable sealed opening, and more particularly to a beverage container with an improved fluid flow structure during consumption of the canned beverage.

2. Background of the Prior Art

The beverage can in commercial use at the present time, features a small, elliptical, sealed opening that is ruptured when a tab is pulled upwardly from the lid. Such a beverage container opening works well with the use of a straw, which is easily capable of withdrawing a sufficient amount of the beverage from the can.

However, the small elliptical opening does not provide for a smooth fluid flow, when the can is inverted in a pour-like mode, in which the canned beverage is consumed directly from the can without the use of a straw. Because of its small size, the elliptical opening gives a surging or restricted flow, since the outside air which needs to enter the can during the outward flow of beverage, competes for the small space provided by the elliptical opening.

For those individuals who drink directly from the lid of the container, such flow is often accompanied by the effects of dribbling. In addition, the small size of this type of opening makes it difficult to remove the last drops of fluid from the container.

Another undesirable feature of this type of can is the lid, which is typically flat and extends in the same plane. A planar lid causes the user neglecting the use of a straw to lift the can at an angle approximating 90° with respect to a horizontal in order to provide a fluid flow in a pour-like mode. One of the consequences of the positioning of the uplifted can is a variable flow rate. Still another undesirable consequence is an awkward posture the user assumes while lifting the can above his head.

As is well known, the tab has a tendency of easily breaking away from the lid. This break-away tab is a constant source of environmental pollution, since it is tossed away and has littered the country-side. Because the tabs are typically aluminum, they do not degrade, and have become a blighted eye-sore in the environment.

It is, therefore, desirable to provide a beverage can with a lid structure that facilitates the consumption of the canned beverage form the can. An opening structure of a beverage can that minimizes the probability that the tab would break away from the can is also desirable.

OBJECTS OF THE INVENTION

An object of the present invention is to provide a beverage can having a structure overcoming the disadvantages of the known prior art Still another object of the present invention is to provide a can opening structure facilitating the consumption of the beverage in a pour-like mode by improving the geometry of the lid.

Yet a further object of the invention is to provide an improved can opening structure.

SUMMARY OF THE INVENTION

Consistent with the above-identified objects, the inventive beverage can has a non-flat lid provided with a downwardly slanted area which is formed with a curved segment serving, when the can is open, as a spout or a guiding element for the canned beverage to flow at a desirable rate.

A combination of the lid's slanted portion with the curved segment eliminates the necessity of lifting the can excessively high in the pour-like mode. The slanted portion provides a support for the upper lip of the user which is thus directly juxtaposed with the opening of the lid. An angle at which the slanted portion is inclined to a planar portion of the lid is selected so that the canned beverage flows directly into the mouth of the user. The curved segment has advantageously a surface, which is shaped complementary to the natural curvature of the user's lower lip during the consumption of the canned beverage.

The tab of the inventive opening structure conforms to the surface of the lid and is shaped to have a front part extending complementary to the slanted portion of the lid. While opening the can, the user applies an external force directed generally perpendicular to the slanted portion. As a result of the slanted portion, the motion used by the user's finger minimizes the probability that the user would also apply a torsion force or a force directed radially to an axis of a rivet, which typically are the main reason for tearing the tab from the lid.

The above and other features of the invention will become clearer and more readily apparent with reference to the accompanying drawings and detailed discussion.

SPECIFIC DESCRIPTION

Figure 1:
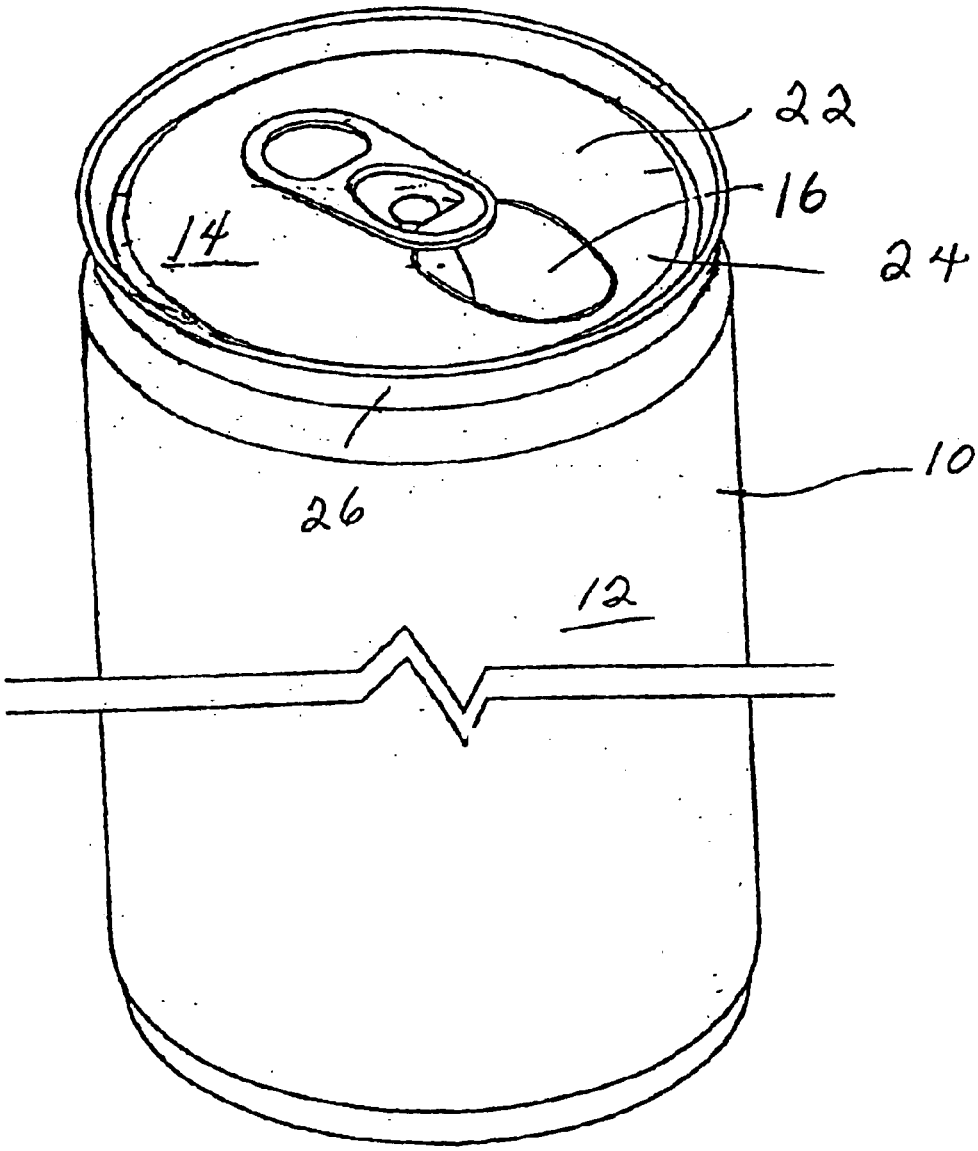
FIG. 1 is an isometric view of an aluminum can widely used in the known prior art.
Figure 2:
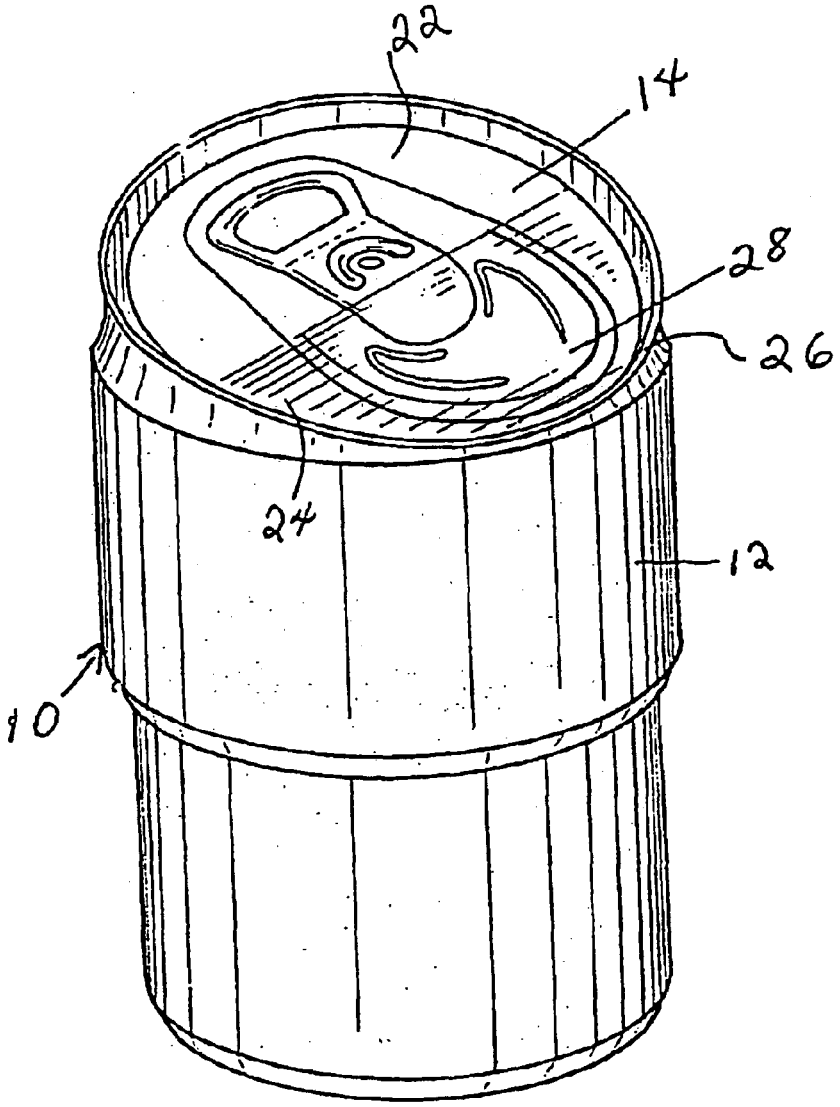
FIG. 2 is an isometric view of a can in accordance with the present invention.

Referring to FIGS. 1–6, and particularly to FIG. 2, a beverage can 10 constructed in accordance with the invention includes a thin walled hollow, body 12 capped with a lid 14. Conventionally, the beverage can 10 is made from metal, such as aluminum or a thin plate, which is coated with aluminum In its construction, the metal body typically has a cylindrical configuration so that a beverage is accommodated therein.

The lid 14 coupled to the body 12 is provided with a discharge hole 16 (seen in FIG. 1) upon applying a force to a distal portion 18 of a tab 20, which customarily has a recess for receiving the user's finger.

In accordance with one aspect of the invention, the lid 14 extends not in a single plane, as shown in FIG. 1 representing the prior art, but in multiple planes at least one which is slanted to facilitate the beverage flow out of the can during a pour-like mode. In particular, the lid 14, as shown in FIG. 2, has a rear planar portion 22 and a front portion 24 extending angularly downwardly from the rear portion toward a rim 26 As shown, both rear and front portions have a uniform size, however, the dimensions of the portions can be modified, such as having the front portion somewhat smaller than the rear portion, to provide an increase in drinking convenience.

Thus, the inventive lid 14 provides the user with an increase in comfort during a pour-like mode by having the front portion 24 inclined downwards, which allows the user not to lift the entire can as high as one would ordinarily do in case of a standard flat lid of the known prior art, as shown in FIG. 1.

Figure 4:
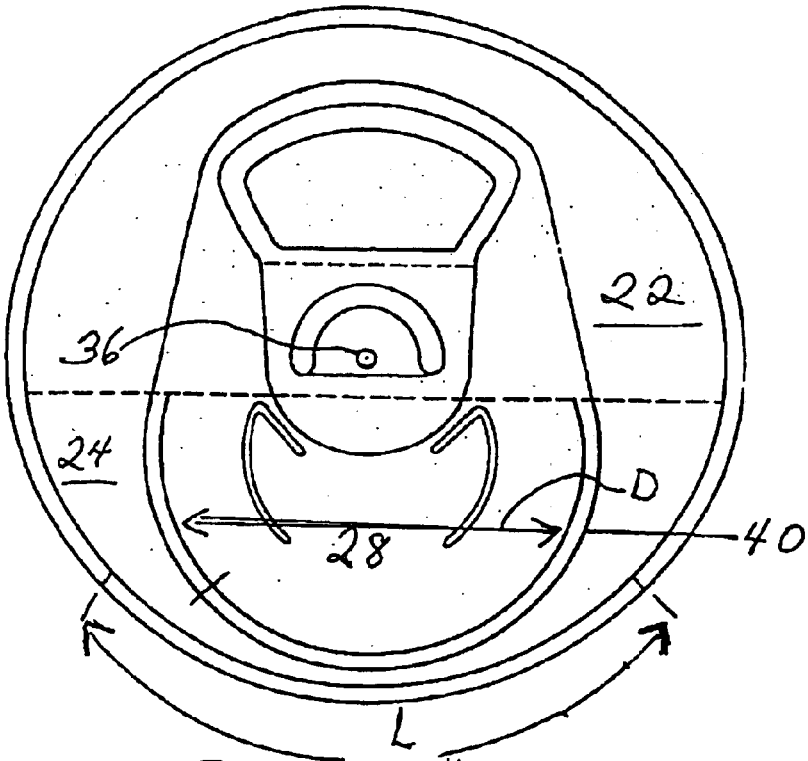
FIG. 4 is a top view of the lid of the inventive can.

According to a further aspect of the invention, the slanted front portion 24 has a land 28 (FIGS. 2 and 6) delimited by the rim 26, which is formed with a dip 30. The land 28 has a parabolic, downwardly curved segment serving as a drink-facilitating groove terminating slightly above the rim 26. The groove extends approximately along a 90° segment of the annular periphery of the lid, as illustrated in FIG. 4, but this particular dimension may vary as a function of the overall dimension of the can and the size of the discharge hole 16. One of the critical requirements of the inventive structure is that the discharge hole 16 should have a diameter D smaller than a chord L defining the dip 30. To provide the user with additional comfort, the dip 30 is shaped so as to have a surface of the rim 26 substantially conform to a curve of the user's lower lip, when the beverage is consumed directly from the can.

The structure of the lid including the planar rear portion 22, the front slanted portion 24 and the dip 30 facilitates the consumption of the beverage directly from the can. The inventive structure also provides a steady rate of beverage flow from the can because the discharge hole 16 can be substantially larger than the standard hole. The consequence of the larger size is that there is still the large space unoccupied with the stream of the beverage that is traversed by the outside air rushing into the can as the beverage is being consumed. In practical terms, there is no competition between the ingress of the outside air and the egress of the beverage for a space, and thus, there is no observable effects of dribbling, which otherwise often accompanies flow of beverage in cans of the prior art, as shown in FIG. 1.

Figure 3:
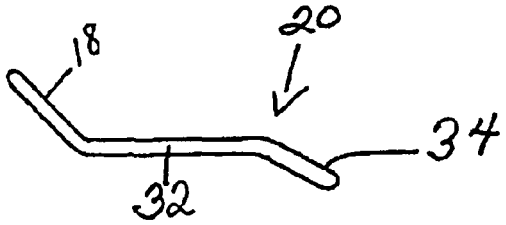
FIG. 3 is a side elevational view of the tab of the inventive can
Figure 5:
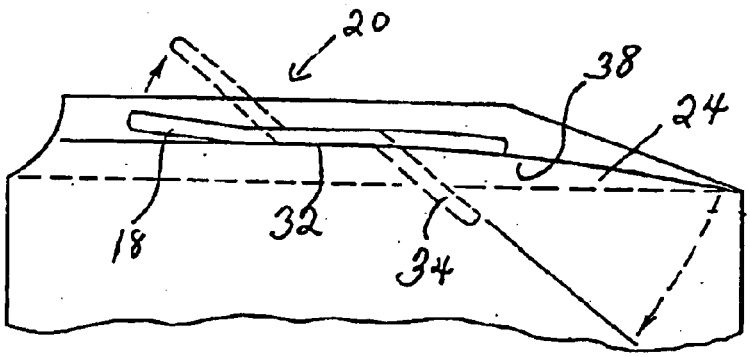
FIG. 5 is a side elevational view of the invention can.
Figure 6:
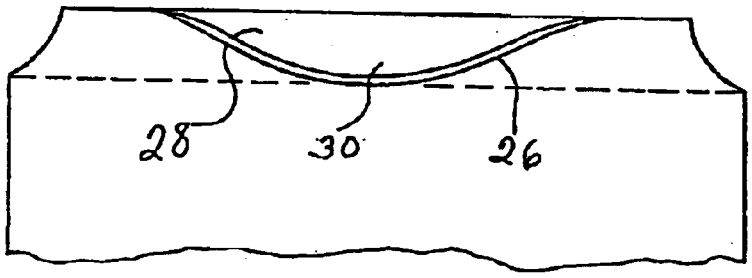
FIG. 6 is a front elevational view of the inventive can.

A further aspect of the invention is illustrated in FIGS. 3 and 5 and relates to the structure of the tab 20 having in addition of the previously disclosed rear or distal portion 18, an intermediate 32 and proximal 34 portions. The distal 18 portion is inclined from 15 to 30° with respect to the intermediate planar portion 32 at a suitable angle to facilitate positioning of the user's finger pulling the tab. The proximal portion 34 extends generally parallel to the slanted portion 24 of the lid 14 at an angle varying between 20° and 35°.

The intermediate portion 32 is coupled to the lid by a rivet 36 (FIG. 4) providing a fulcrum for the tab 20 in response to the external force applied by the user. If the external force is sufficient, the proximal part pivots downwardly to press and rupture a seal plate 38, which is integrally formed with the lid 14 to close the discharging hole 16 along a score line 40, as better seen in FIG. 4.

As opposed to the known structures, because of the proximal portion is inclined as disclosed, a pulling force is directed substantially perpendicular to inclined front portion 24 of the lid 14. Typically, the structure of the known art, as shown in FIG. 1, causes the user to awkwardly position his arm with respect to the lid of the can, particularly if the can is placed on the flat surface. As a consequence, the user often twists the distal portion 20 of the tab, the motion that can result in the separation of the tab from the can. Thus, the slanted front portion 24 of the lid along with the front portion 34 of the tab 20 provides a structure minimizing the probability that the tab 20 would be broken away from the lid.

While the invention has been disclosed with respect to preferred embodiments, various changes can be made without departing from the scope of the invention as defined by the appending claims.

What is claimed is:

1. A beverage can comprising:

a generally cylindrical body having a closed bottom;

a lid formed with a tab operable to form a dischargeable opening in the lid close to a rim of the generally cylindrical body, the lid having a rear portion and a slanted front portion extending angularly downwards from the rear portion, the slanted front portion including the dischargeable opening running from the rear portion to the rim, the rim having a dip below the dischargeable opening and forming a drinking-facilitating groove terminating slightly above the rim in a periphery of a top of the generally cylindrical body.

2. The beverage can according to claim 1, wherein the slanted portion extends at an angle varying from about 25° to about 35° with respect to a horizontal.

3. The beverage can according to claim 2, wherein the rear portion of the lid is flat and lies in a plane extending parallel to the horizontal.

4. The beverage can according to claim 1, wherein the dip extends approximately along a 90° peripheral segment and at an angle more acute than an angle of the slanted portion.

5. The beverage can according claim 1, wherein the slanted and rear portions are substantially equally dimensioned.

6. The beverage can according to claim 1, wherein the slanted portion is dimensioned differently from the rear portion of the lid.

7. The beverage can according to claim 1, wherein the tab has a rear portion extending angularly upwards from the rear portion of the lid, which extends in a horizontal plane, an intermediate portion extending parallel to and riveted to the rear portion of the lid and a front portion extending parallel to the slanted front portion of the lid.

8. The beverage can according to claim 7, wherein the rear portion of the tab extends upwards at an angle varying from 15 to 30° with respect to a horizontal.

9. The beverage can according to claim 1, wherein the slanted front portion has a downwardly curved segment terminating next to the rim, the clip of the rim being downwardly convex and terminating below the downwardly curved segment.

10. The beverage can according to claim 6, wherein the slanted front portion of the lid is smaller or larger than the rear portion of the lid.

11. A beverage can comprising:

a body having a closed bottom; and a lid spaced from the closed bottom and formed with a tab, the lid having a rear portion and a front portion extending angularly downwards from the rear portion and having a downwardly curved segment terminating slightly above a top rim of the body, wherein the tab extends into the downwardly curved segment and is operable to form a dischargeable opening.

12. A beverage can comprising:

a generally cylindrical body having a closed bottom;

a lid formed with a tab operable to form a dischargeable opening in the lid close to a rim of the generally cylindrical body, the lid having a rear portion and a slanted front portion extending angularly downwards from the rear portion, the slanted front portion including the dischargeable opening running from the rear portion to the rim and having a land delimited by the rim and having a parabolic, downwardly curved segment terminating slightly above the rim having a dip below the dischargeable opening, and the land and dip together forming a drinking-facilitating groove in a periphery of a top of the generally cylindrical body.

13. The beverage can according to claim 1, wherein the dip is shaped to have a surface of the rim substantially conform to a surface of a lower lip of an individual consuming beverage directly from the can.

14. The beverage can according to claim 11, wherein the downwardly curved segment is shaped to have a surface of the rim substantially conform to a surface of a lower lip of an individual consuming beverage directly from the can.

15. The beverage can according to claim 12, wherein the dip is shaped to have a surface of the rim substantially conform to a surface of a lower lip of an individual consuming beverage directly from the can.

16. A beverage can comprising:

a generally cylindrical body having a closed bottom;

a lid formed with a tab operable to form a dischargeable opening in the lid close to a rim of the generally cylindrical body, the lid having a rear portion and a slanted front portion extending angularly downwards from the rear portion, the slanted front portion including the dischargeable opening running from the rear portion to the rim, the rim having a dip below the dischargeable opening and forming a drinking-facilitating groove terminating above the rim in a periphery of a top of the generally cylindrical body.

17. The beverage can according to claim 1, wherein said cylindrical body comprises two portions of varying diameter, with the portion of larger diameter adjacent the lid and the portion of smaller diameter adjacent the closed bottom.

18. The beverage can according to claim 11, wherein said body comprises two portions of varying diameter, with the portion of larger diameter adjacent the lid and the portion of smaller diameter adjacent the closed bottom.

19. The beverage can according to claim 12, wherein said cylindrical body comprises two portions of varying diameter, with the portion of larger diameter adjacent the lid and the portion of smaller diameter adjacent the closed bottom.

20. The beverage can according to claim 16, wherein said cylindrical body comprises two portions of varying diameter, with the portion of larger diameter adjacent the lid and the portion of smaller diameter adjacent the closed bottom.

* * * * *